US006085468A

United States Patent [19]

Quiring et al.

[11] Patent Number: 6,085,468

[45] **Date of Patent: *Jul. 11, 2000**

[54] TRUSS FOR FABRIC COVERED BUILDINGS AND THE LIKE

[75] Inventors: Richard Quiring; Nathan Stobbe, both of Saskatchewan, Canada

[73] Assignee: Cover-All Shelter Systems, Saskatchewan, Canada

[ * ] Notice: This patent is subject to a terminal disclaimer.

[21] Appl. No.: 09/296,995

[22] Filed: Apr. 22, 1999

Related U.S. Application Data

[63] Continuation-in-part of application No. 08/922,713, Sep. 2, 1997, Pat. No. 6,026,613.

[51] Int. Cl.[7] ..... E04B 1/32; E04B 1/19; E04B 1/342; E04C 3/04

[52] U.S. Cl. ..... 52/63; 52/88; 52/273; 52/652.1; 52/653.1; 52/655.1; 52/694

[58] Field of Search ..... 52/63, 222, 273, 52/646, 652.1, 653.1, 655.1, 694, 86, 88

[56] References Cited

U.S. PATENT DOCUMENTS 2,278,797 4/1942 Raymond .
2,693,195 11/1954 Frieder et al. .
2,828,756 4/1958 Worley .
3,019,491 2/1962 Troutner .
3,924,368 12/1975 Pedersen .
4,253,210 3/1981 Racicot .
4,259,819 4/1981 Wemyss .
4,748,786 6/1988 Hannah .
5,269,106 12/1993 Stafford et al. .

*Primary Examiner*—Christopher T. Kent
*Attorney, Agent, or Firm*—Patterson & Keough, P.A.

[57] ABSTRACT

The present invention provides a strong yet lightweight truss which could be used in many applications, and is adapted particularly to a support framework for those fabric covered structures utilizing a fabric stretched over the top of the supporting framework. The truss can be made up into sections comprising tubular upper and lower truss members separated by a continuous tubular web. The coupling plates may be attached to each end of the sections such that the top edge of the coupling plate is below the upper side of the upper member, providing a smooth upper surface to the truss and eliminating wear points which could damage the fabric or other material stretched over or supported by the truss. The truss is easily transported and manufactured.

16 Claims, 9 Drawing Sheets

TRUSS FOR FABRIC COVERED BUILDINGS AND THE LIKE

This is a Continuation-in-Part of Application No. 08/922,713 filed Sep. 2, 1997, now U.S. Pat. No. 6,026,613.

The invention is in the field of trusses for construction of buildings and in particular such trusses for use in prefabricated, fabric covered buildings, which may be arcuate.

BACKGROUND:

Fabric covered buildings are well known wherein a plurality of supports, often made of tubing, are erected on a foundation base and held in spaced apart relationship by purlins connected between them. The structure is then covered with fabric, somewhat analogous to a tent. Such buildings are economical, fast and easy to erect and maintain, durable and easy to relocate. These features have made fabric covered buildings very popular, and led to demand for ever longer and wider buildings. However, these wider buildings are subject to much higher loads from wind, snow and so forth. The standard single member arch is unable to withstand these loads.

Truss arches, such as that shown in U.S. Pat. No. 5,269,106 to Stafford et al., have been utilized to provide the increased strength need for larger a fabric covered building, and in particular such a building wherein a single sheet of fabric is pulled over the framework and secured on each side. The Stafford patent teaches a truss arch for use in a building wherein the fabric covering takes the form of panels joined to each arch, thereby covering the area between a pair of spaced apart arches. The arch members are extruded channel members.

Fabric covered buildings are also known wherein a single piece of fabric is stretched over the top of a supporting frame, and secured by ropes and so forth. In this type of building it is very important to eliminate anything on the support structure and arches that might tear the fabric or provide a wear point as the fabric flexes due to wind and so forth.

Trusses are often manufactured of aluminum so that increased strength is available while keeping weight low and thereby contributing to ease and economy of erection and transport. Use of aluminum is, however, more expensive than using steel.

SUMMARY OF THE INVENTION:

It is an object of the present invention to provide a structural truss which is strong enough to withstand the increased loads of wide buildings, while being of relatively light weight.

It is a further object of the present invention to provide such a structural truss which is economical to manufacture and transport.

It is a further object of the present invention to provide such a structural truss which is particularly useful in forming a support framework for a fabric covered building, and in particular such a building wherein a single sheet of fabric is maintained over the framework and secured on each side.

The invention, a structural truss, accomplishes these objects and may be assembled into a plurality of adjacent sections in end to end alignment, each section comprising a hollow upper member, a hollow lower member, each or both of which may be arcuate, a continuous hollow reinforcing web bent so as to alternately contact the lower side of the upper member and the upper side of the lower member at a number of contact points at which contact points the web is attached to the respective member. A coupling plate at each end of each section is attached to both the upper member and the lower member providing section coupling means to connect the coupling plate of one section to the coupling plate of the adjacent section such that their respective upper members are in alignment. Foundation anchoring means may connect the coupling plates at the ends of the structural truss to a foundation. Two or more sections could be used depending on the size of the truss required.

More specifically, the a structural truss of the invention may be coupled with at least one intermediate section in end to end alignment with two outside sections, each section comprising a upper member and a lower member, each of which may be arctuate, a continuous reinforcing web, said web bent so as to alternately contact the lower side of said upper member and the upper side of said lower member, at which contact points said web is welded to the member, a coupling plate at each end of each intermediate section and at one end of each outside section, said coupling plate attached by welding to both said upper member and said lower member, the attachment to the upper member being such that the top edge of said coupling plate is below the upper side of the upper member, and a base plate at the opposite end of each said outside section; means to connect the coupling plate of one section to the coupling plate of the next section in said end to end alignment such that their respective upper members are in alignment; and means to connect the base plates to a ground anchoring foundation. One or more intermediate sections could be used depending on the size of the truss required.

The attachment of the web to the upper and lower members at the contact points can be accomplished by welding each side thereof Similarly, the coupling plates can be attached to the upper and lower members of their respective sections by welding.

The use of hollow tubing for the reinforcing web offers several advantages over the usual solid rod or bar web material which more than compensate for the greater difficulty involved in making the bends. The tubing has a larger width than solid stock of the same strength, with the result that when the tubing is bent to weave between the upper member and the lower member, a much larger surface area is presented for welding between the member and the web tubing. Another advantage is that the welds on each side of the web are separated by approximately the width of the tubing. The resulting welded connection between the web and the member is distributed over a greater area of the member than would be the case with smaller solid stock web material and is therefore stronger. The invention thereby also the use of relatively thin-walled tubing for the upper and lower truss members, keeping cost and weight down while still providing the required strength. The tubing may be of circular or rectilinear cross-section, however a circular cross section is generally the most economical.

The sections of the truss can be coupled together using bolts through mating holes in the coupling plates at the respective meeting ends of the truss sections. Similarly the completed truss can be anchored to its structural foundation using bolts through holes in the end coupling plates or base plates of the truss, or other anchoring means could be used Further features of the invention are directed to its suitability for use in a fabric covered building of the type wherein a single sheet of fabric is maintained over the framework and secured on each side. The upper truss member intersects the upper edge of the coupling plate so that the top of the coupling plate is below the top surface of the truss. This results in the top surface of the truss, which is in contact with the fabric covering, being simply the top of the upper members with a smooth transition from one section's upper member to the next sections upper member.

In the preferred embodiment, any gap between upper members is negligible due to the novel coupling plate which includes a hole intersecting the top edge of said coupling plate to accept the upper member, resulting in the upper member ending flush with the outside of the coupling plate so that when the sections are connected, the upper members are flush. The lower member similarly extends through a hole in the coupling plate, as the resulting welded joint between the member and the coupling plate is stronger than a butt joint.

The coupling plate in the preferred embodiment also has a triangularly shaped top portion, with the top edges adjacent to the intersecting hole sloped down, removing the corners of the coupling plate even further from the vicinity of the fabric. The resulting truss thus presents no corners or other obstructions which might tear the fabric, or provide wear points.

The present invention is an improvement over present trusses, providing an economical truss design, suitable for manufacture from steel, which results in a strong yet light-weight truss which could be used in many applications, and with certain design features which adapt it particularly to those fabric covered structures utilizing a single piece of fabric stretched over the top of a supporting frame A fabric covered building using the invention, comprising a support framework consisting of a plurality of the contemplated structural trusses, laterally spaced and secured by purlins between adjacent trusses, with said framework attached to a ground anchoring foundation; and a sheet of fabric covering said support framework, each edge of the sheet nearest the truss base plates being secured to the framework or the foundation and tensioned, and each edge of the sheet nearest the last truss in the framework, being secured to said framework, is also disclosed.

DESCRIPTION OF THE DRAWINGS:

While the invention is claimed in the concluding portion hereof, preferred embodiments are provided in the accompanying detailed description which may be best understood in conjunction with the accompanying diagrams where like parts in each of the several diagrams are labeled with like numbers, and where:

DETAILED DESCRIPTION OF THE ILLUSTRATED EMBODIMENTS:

The invention provides a structural truss comprising at least one intermediate section in end to end alignment with two outside sections, each intermediate and outside section comprising a hollow arctuate upper member; a hollow arctuate lower member; a continuous hollow reinforcing web, bent so as to alternately contact the lower side of the upper member and the upper side of the lower member at a number of contact points at which contact points the web is attached to the respective member; a coupling plate at each end of each intermediate section and at one end of each outside section, said coupling plate attached by welding to both said upper member and said lower member, the attachment to the upper member being such that the top edge of said coupling plate is below the upper side of the upper member; and a base plate at the opposite end of each said outside section; section coupling means to connect the coupling plate of one section to the coupling plate of the adjacent section such that their respective upper members are in alignment; and foundation anchoring means to connect the base plates to a ground anchoring foundation. The number of intermediate sections used might be varied depending upon the size of the truss required, or the size of the sections, which could also be varied.

FIGS. 1 to 8 show the various parts of one preferred embodiment of the invention, directed in particular to application in a support framework for fabric covered buildings wherein a single sheet of fabric is pulled over the framework and secured on each side.

Figure 1:
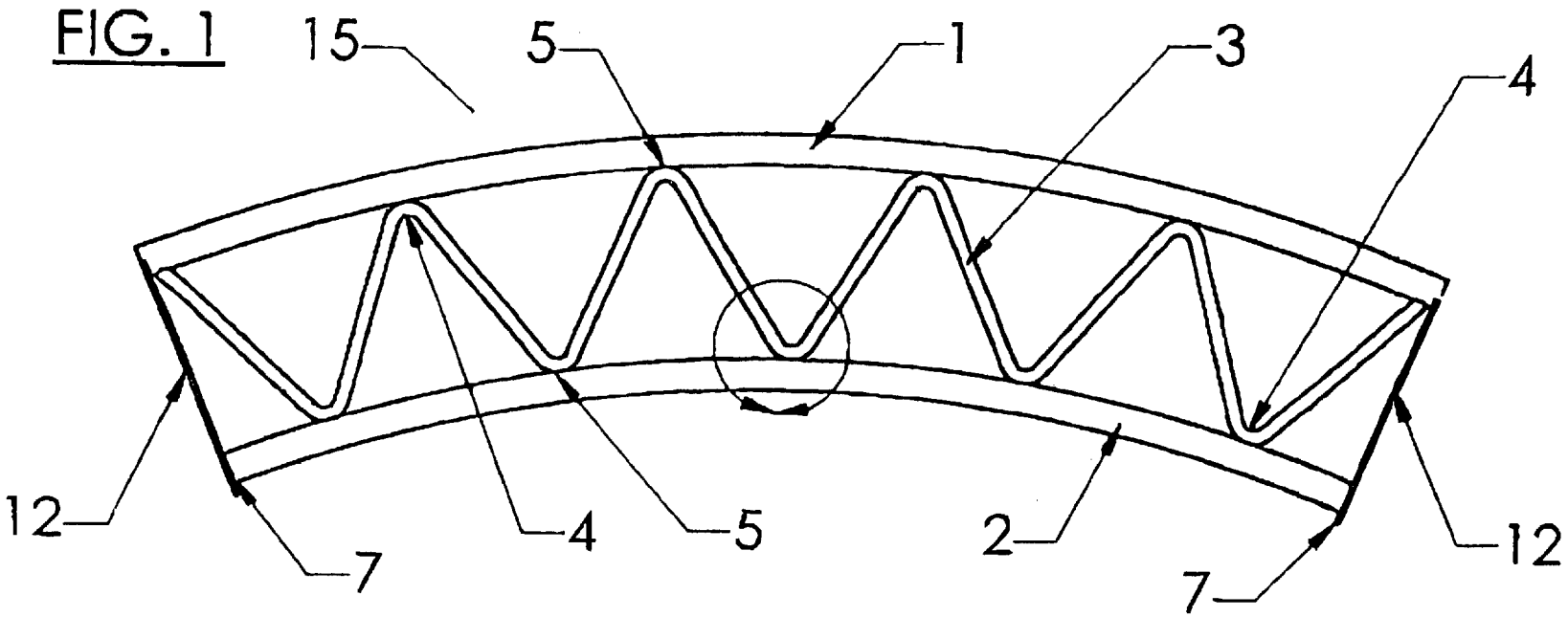
FIG. 1 is a plane side view of an intermediate section of one embodiment of the invention.
Figure 1A:
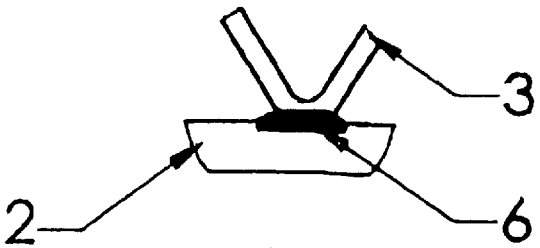
FIG. 1A is a magnified plane side view showing the welding of the web to the upper and lower members of the truss.
Figure 2:
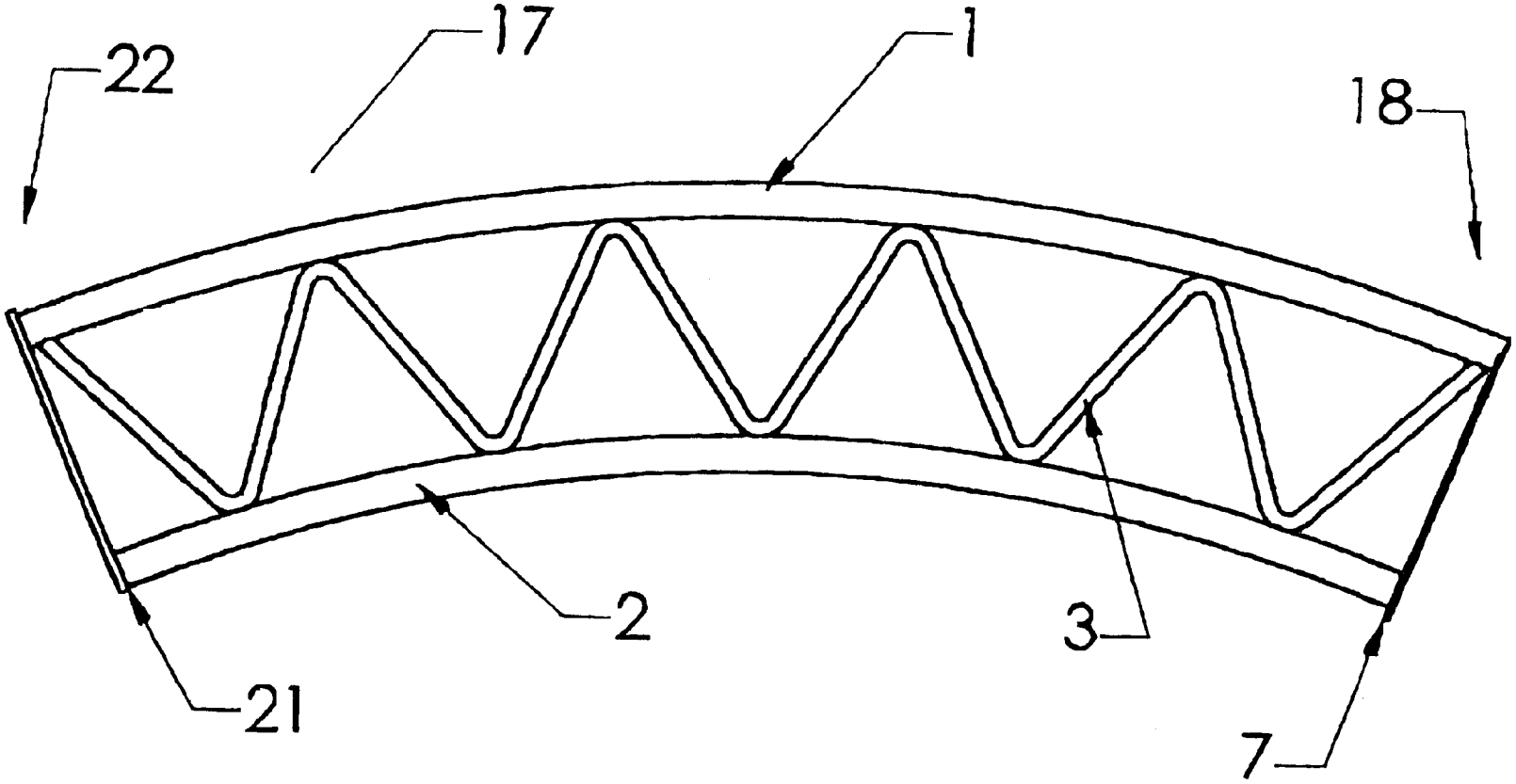
FIG. 2 is a plane side view of the outside section of the embodiment of FIG. 1.
Figure 9:
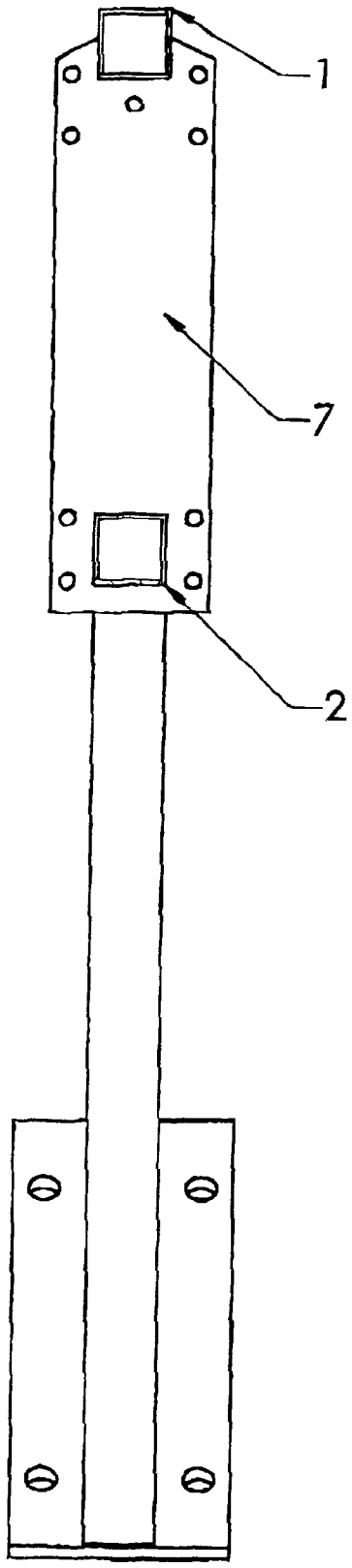
FIG 9 is a plane front view of an alternate embodiment using tubing with a rectilinear cross-section.

FIG. 1 shows the construction of the intermediate section, with FIG. 2 showing the construction of an outside section. Both intermediate sections 15 and outside sections 17 are made up of upper truss member 1 and lower truss member 2, which in this embodiment are arcuate steel tubes of circular cross section having a wall thickness of fourteen gauge and an outside diameter of 2.375 inches, being relatively light weight in order to reduce weight. It is contemplated that tubing with a square or rectilinear cross-section would work satisfactorily as well, and that another suitable metal such as aluminum could be used instead of steel. A truss with a rectilinear cross-section is illustrated in FIG. 9.

Truss web 3 in this embodiment is a steel tube of circular cross section having a wall thickness of 14 gauge and an outside diameter of one inch. It is contemplated that tubing with a square or rectilinear cross-section would work satisfactorily as well, and that another suitable metal such as aluminum could be used instead of steel. The web 3 is bent at comers 4 so as to alternately contact the upper member 1 and the lower member 2 at contact points 5. The web 3 is welded to said upper member 1 and lower member 2 by web weld beads 6 on each side of the web 3.

Figure 3:
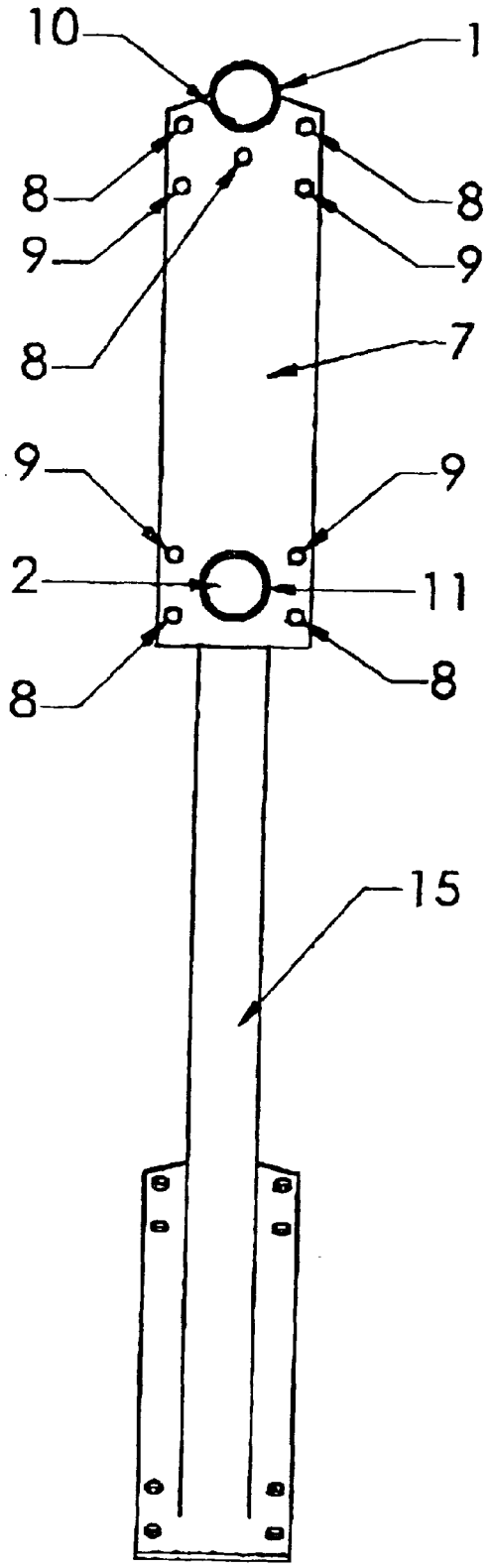
FIG. 3 is a plane front view of the coupling plate of the embodiment of FIG. 1.
Figure 4:
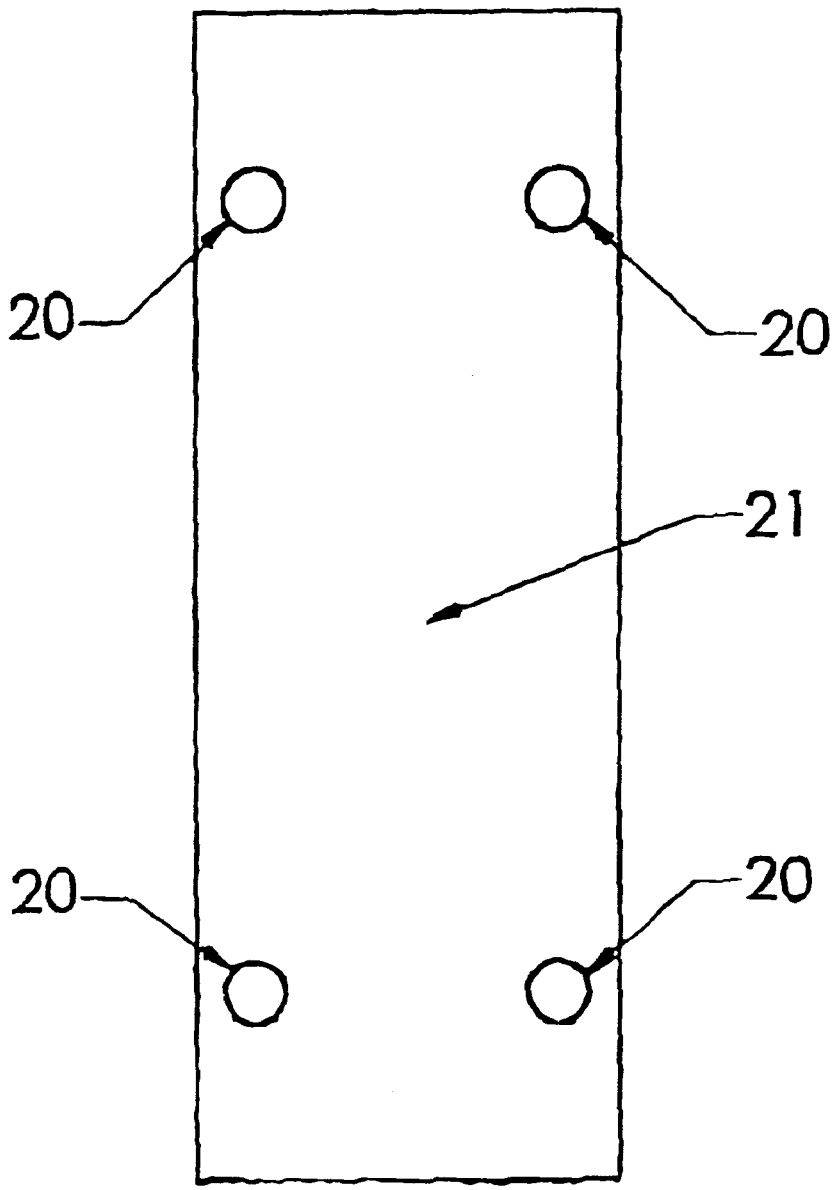
FIG. 4 is a plane front view of the base plate of the outside section of FIG. 2.

At both ends of intermediate sections 15, and at inner ends 18 of the outside sections 17, are attached coupling plates 7. The coupling plate 7 is shown in FIG. 3 having the shape of a triangle on top of a rectangle. Upper hole 10 intersects the top of the triangle and bottom hole 11 is located in proximity to the bottom of the coupling plate 7. Coupling bolt holes 8 and purlin holes 9 are shown in the coupling plate 7. Upper member 1 is inserted into upper hole 10 in coupling plate 7 so that the end of the upper member 1 is flush with the outside 12 of the coupling plate 7. Lower member 2 is inserted into bottom hole 11 in coupling plate 7 so that the end of the lower member 2 is flush with the outside 12 of the coupling plate 7. The upper member 1 and lower member 2 are welded to the coupling plate 7.

Base plates 21 are welded to outside ends 22 of outside sections 17. The base plate is shown in detail at FIG. 4.

Figure 5:
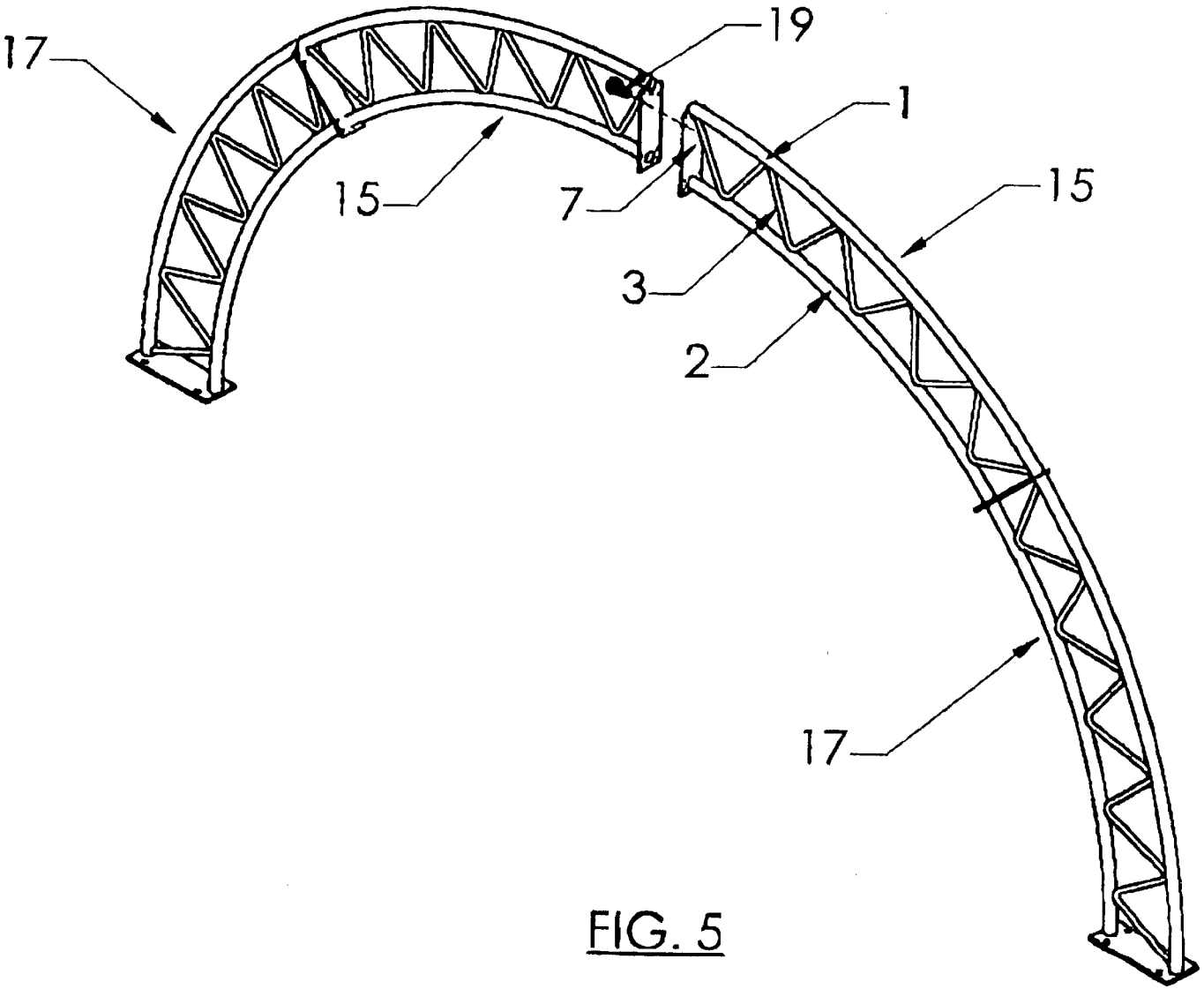
FIG. 5 shows construction of the truss arch embodiment constructed from sections in FIGS. 1 and 2.

As is demonstrated in FIG. 5, the truss arch 23 is made up of two intermediate sections 15 between, and in end to end alignment with, two outside sections 17. The intermediate sections 15 and outside sections 17 are joined by bolts 19 through coupling bolt holes 8 in coupling plates 7, forming truss arch 23. While bolts and mating holes are shown in this embodiment as the section coupling means, it will be understood that other types of section coupling means could be used and are contemplated within the scope of the invention. For example, clamps or other fasteners might be used.

Figure 6:
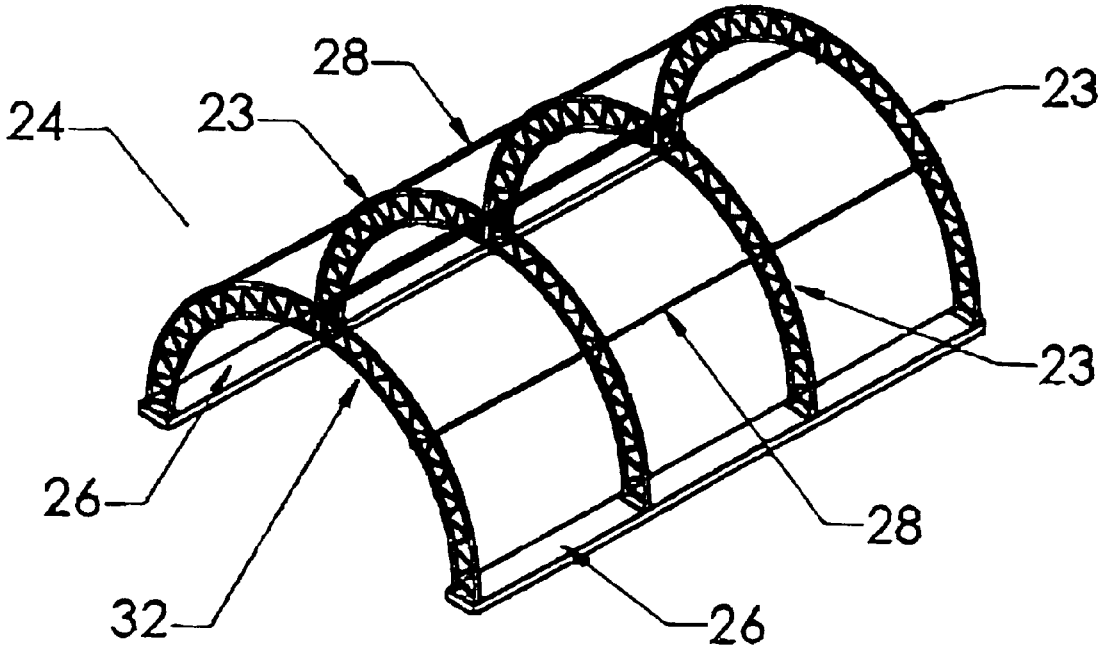
FIG. 6 is a perspective view of the support framework of an embodiment of a fabric covered building employing the embodiment of the truss arch of FIG. 5.
Figure 7:
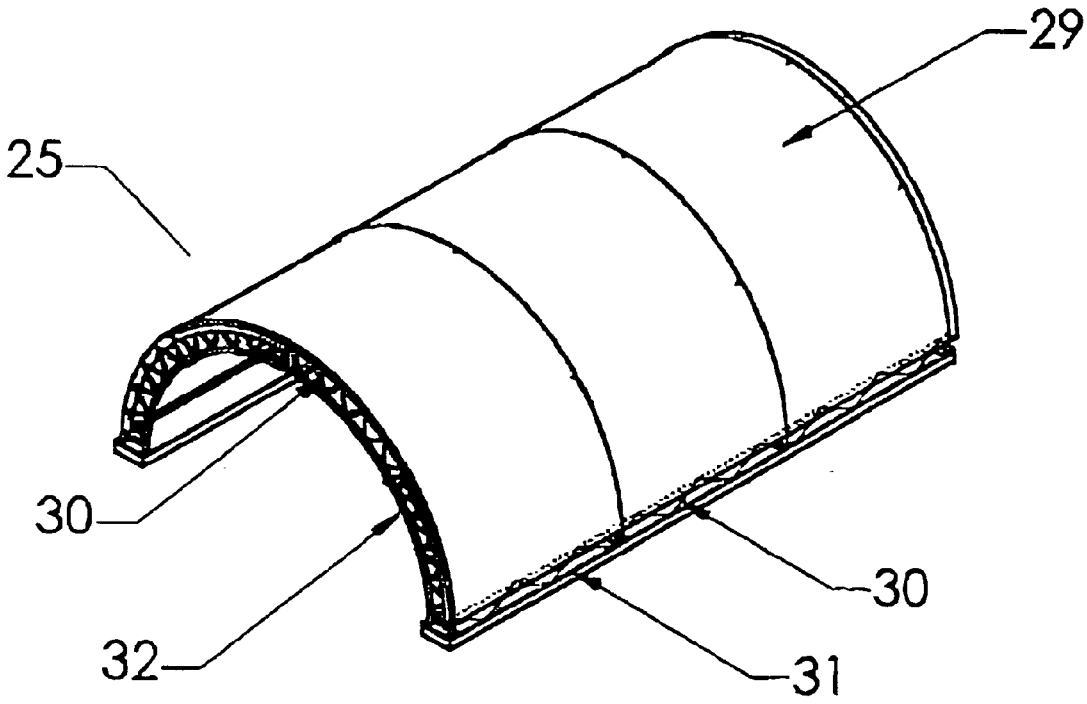
FIG. 7 is a perspective view of the embodiment of FIG. 6 with the fabric membrane of the building in place.
Figure 8:
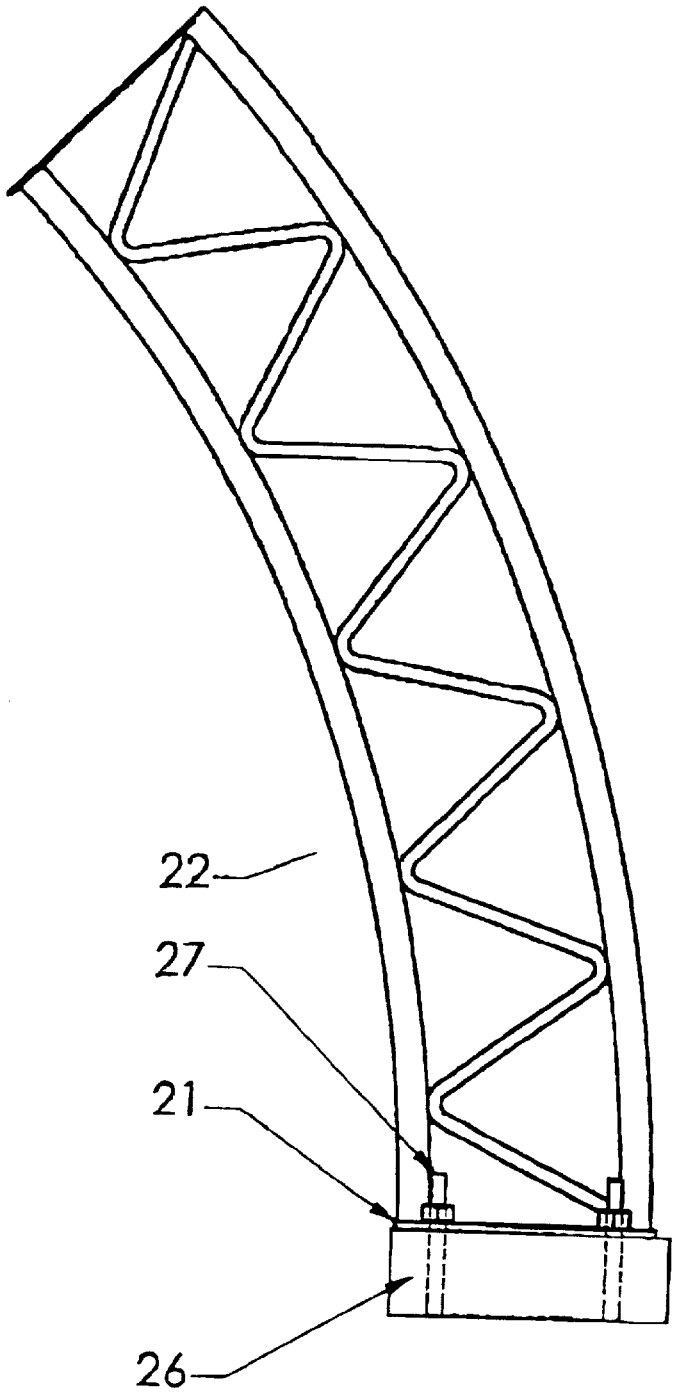
FIG. 8 is a plane side view of one embodiment of the connection of the base plate to the ground anchoring foundation.

Referencing FIG. 6, to erect the support framework 24 for the fabric covered building 25, a number of completed truss arches 23 are laterally spaced on ground anchoring foundations 26 by raising said truss arches 23 and securing the base plates 21 to bolts 27 extending from the ground anchoring foundations 26 through base plate holes 20. While bolts are used in this embodiment as the foundation anchoring means, it will be understood that other foundation anchoring means might be employed as well and such are contemplated within the scope of the invention. For example depending on the degree of permanency of the location of the building, or other factors, concrete anchors might be used.

Purlins 28 are attached by conventional means between the lower members 2, the purlin holes 9 in coupling plates 7, and between the webs 3 on adjacent truss arches 23 at several locations along the perimeter of the truss arches 23.

Fabric membrane 29 is pulled over the support framework 24 and secured by ropes 30 to tie down bars 31 attached to the ground anchoring foundations 26 and secured by ropes 30 to the end truss arches 32.

While the truss of the invention is shown in a fabric covered building application, it will be understood that other applications exist for the truss as well and those are contemplated within the scope of the invention as well. The truss disclosed would also support a building covered with flexible sheets of metal or plastic with the addition of suitable cross supports.

Thus it can be seen that the invention accomplishes all of its stated objectives. The foregoing is considered as illustrative only of the principles of the invention. Further, since numerous changes and modifications will readily occur to those skilled in the an, it is not desired to limit the invention to the exact construction and operation shown and described, and accordingly, all such suitable changes or modifications in structure or operation which may be resorted to are intended to fall within the scope of the claimed invention.

We claim:

1. A structural truss section comprising:

a hollow upper member; a hollow lower member; a substantially continuous hollow reinforcing web, bent so as to alternately contact the lower side of the upper member and the upper side of the lower member at a number of contact points at which contact points the web is attached to the respective member; and means to connect the section to an adjacent section.

2. The invention of claim 1 wherein the means to connect the section to an adjacent section is such that the upper members of adjacent sections are in alignment.

3. The invention of claim 1 wherein the web is attached to the upper and lower members at the contact points by welding each side thereof.

4. The invention of claim 1 wherein any hollow member or web has a circular cross-section.

5. The invention of claim 1 wherein any hollow member or web has a rectilinear cross-section.

6. A structural truss comprising a plurality of adjacent sections connected to each other in end to end alignment, each section comprising a hollow upper member;

a hollow lower member; a substantially continuous hollow reinforcing web, bent so as to alternately contact the lower side of the upper member and the upper side of the lower member at a number of contact points at which contact points the web is attached to the respective member.

7. The invention of claim 6 wherein the web is attached to the upper and lower members at the contact points by welding each side thereof.

8. The invention of claim 6 wherein the number of sections is two.

9. The invention of claim 6 wherein the number of sections is more than two.

10. A structural truss for use in supporting a fabric covered building comprising:

at least one intermediate section in end to end alignment with two outside sections, at least one of said intermediate and outside sections comprising a hollow upper member; a hollow lower member; a substantially continuous hollow reinforcing web, bent so as to alternately contact the lower side of the upper member and the upper side of the lower member at a number of contact points at which contact points the web is attached to the respective member; a coupling plate at each end of each intermediate section and at one end of each outside section, said coupling plate attached to both said upper member and said lower member, the attachment to the upper member being such that the top edge of said coupling plate is below the upper side of the upper member; and a base plate at the opposite end of each said outside section; and means to connect the coupling plate of one section to the coupling plate of the adjacent section in said end to end alignment such that their respective upper members are in alignment.

11. The invention of claim 10 wherein the web is attached to the upper and lower members at the contact points by welding each side thereof.

12. The invention of claim 10 wherein the coupling plate comprises a steel plate, said plate having a hole in a lower portion thereof to accept the lower member, and a hole intersecting the top edge thereof to accept the upper member, and further having holes therein to accept mounting bolts.

13. The invention of claim 10 wherein the number of intermediate sections is one.

14. The invention of claim 10 wherein the number of intermediate sections is more than one.

15. A fabric covered building comprising:

a support framework comprising a plurality of structural trusses at least one of which comprises a plurality of adjacent sections in end to end alignment, at least one of which sections comprises a hollow upper member; a hollow lower member; a substantially continuous hollow reinforcing web, bent so as to alternately contact the lower side of the upper member and the upper side of the lower member at a number of contact points at which contact points the web is attached to the respective member; and a coupling means at each end of each section attached to both the upper member and the lower member; means to connect the coupling means of one section to the coupling means of the adjacent section such that their respective upper members are in alignment; and anchoring means anchoring the ends of the structural trusses; said trusses laterally spaced and secured by purlins extending between adjacent trusses, and means to anchor said framework to the ground; and a sheet of fabric covering said support framework.

16. The invention of claim 15 wherein the web is attached to the upper and lower members at the contact points by welding each side thereof.

* * * * *